United States Patent [19]

Sekihara et al.

[11] Patent Number: 4,955,681

[45] Date of Patent: Sep. 11, 1990

[54] IMAGE DISPLAY APPARATUS HAVING SHEET LIKE VERTICAL AND HORIZONTAL DEFLECTION ELECTRODES

[75] Inventors: Toshinobu Sekihara, Osaka; Mitsunori Yokomakura, Takatsuki; Yuichi Moriyama, Ibaraki; Michiaki Watanabe, Ibaraki; Tomohiro Sekiguchi, Ibaraki; Keiji Nagata, Hirakata; Takatsugu Kurata, Ibaraki, all of Japan

[73] Assignee: Matsushita Electric Industrial Co., Ltd., Kadoma, Japan

[21] Appl. No.: 271,821

[22] Filed: Nov. 16, 1988

[30] Foreign Application Priority Data

Nov. 16, 1987 [JP] Japan ..... 62-288762
Jul. 25, 1988 [JP] Japan ..... 63-184962

[51] Int. Cl.[5] ..... H01J 19/28; H01J 29/74

[52] U.S. Cl. ..... 313/495; 313/422; 313/426

[58] Field of Search ..... 313/495, 422, 413, 421, 313/426

[56] References Cited

U.S. PATENT DOCUMENTS 4,227,117 10/1980 Watanabe et al. ..... 313/422 X
4,449,148 5/1984 Inohara et al. ..... 313/422 X
4,451,846 5/1984 Iyehara et al. ..... 358/56

FOREIGN PATENT DOCUMENTS 50295 4/1982 European Pat. Off. ..... 313/422
2742555 3/1978 Fed. Rep. of Germany .
2499764 8/1982 France .

*Primary Examiner*—Kenneth Wieder
*Attorney, Agent, or Firm*—Cushman, Darby & Cushman

[57] ABSTRACT

In an image display apparatus, horizontal-extended line cathodes (22a–22d), an electron beam extraction electrode (23), a control electrode (24), a first focusing electrode (25) having horizontal-elongated apertures (35, 45), a second focusing electrode (26) having vertical-elongated apertures (36, 46), a horizontal deflection electrode (27a, 27b), a vertical deflection electrode (28a, 28b) and a screen (29) are provided in this order toward a travelling direction of electron beam, and each of both deflection electrodes comprises a pair of comb-shaped conductive sheets which are insulatedly interdigitated with each other on the same vertical plane.

10 Claims, 5 Drawing Sheets

IMAGE DISPLAY APPARATUS HAVING SHEET LIKE VERTICAL AND HORIZONTAL DEFLECTION ELECTRODES

FIELD OF THE INVENTION AND RELATED ART STATEMENT

1. Field of the Invention

The present invention relates to an image display apparatus.

2. Description of the Related Art

Heretofore, a cathode ray tube has mainly been used as an image display apparatus of a color television set. Since the cathode ray tube has very long depth in comparison with size of its faceplate, it has been impossible to make a flat type television set. An EL (electroluminescent) display device, a plasma display device or a liquid crystal display device etc. have been presented to offer the flat type TV set, but neither of them has been able to offer satisfactory performance such as luminance, contrast and color reproducibility. In order to obtain the flat type image display apparatus which presents high quality image similar to the cathode ray tube by employing electron beams, such an image display apparatus wherein the image on a fluorescent screen is divided into plural sections of matrix arrangement with no gap therebetween is presented. The electron beams are deflected and scanned within each divided section, and the whole image of color TV is formed by arranging all divided sectional images.

FIG. 6 is an internal perspective view of the conventional image display apparatus disclosed in Japanese examined patent publication Sho No. 58-32897. In the figure, electrons are generated from line cathodes 2*a*, 2*b*, 2*c* and 2*d* and formed into a predetermined number of separate electron beams 11 by passing through a hole 10 formed in an electron beam extraction electrode 3. The electron beams 11 are further controlled, focused and deflected by passing through a control electrode 4, a focusing electrode 5, a vertical deflection electrode 6, a horizontal deflection electrode 7 and a shield electrode 8, and finally scan respective sectional screens 12 which are formed by dividing a flat plate-shaped screen 9 into matrix arrangement. The whole image is obtained on the screen 9 as a combination of images on all sectional screens 12 with no gap therebetween.

In the above-mentioned conventional image display apparatus, there exist the following problems. For instance, since focusing of each electron beam by the focusing electrode is not sufficient in comparison with the ordinary type cathode ray tube, a diameter of beam spot on the screen is not sufficiently small. As a result, resolution is not excellent. Besides, since adjacent two fluorescent elements may simultaneously emit light by receiving one electron beam, color purity becomes worse. Especially, since electron beam emitting source comprises long and thin line cathodes parallelly extended in the horizontal direction, it is difficult to desirably focus the electron beams in the horizontal direction. Such a rough electrostatic lens formed by a circular hole 13 in the focusing electrode 5 cannot realize excellent horizontal focusing.

OBJECT AND SUMMARY OF THE INVENTION

The object of the present invention is to offer an image display apparatus which can display high quality image.

In order to achieve the above-mentioned object, the image display apparatus in accordance with the present invention comprises:

a plurality of line cathodes which are extended in parallel with each other to emit electrons;

an electron beam extraction electrode for extracting electron beams from the line cathodes;

a control electrode for selectively controlling passing amount of electron beams having passed through the electron beam extraction electrode;

a focusing electrode for electrostatically focusing electron beams having passed through the control electrode, the focusing electrode being made of a conductive sheet wherein a plurality of oblong apertures elongated in an extended direction of the line cathodes are formed;

a deflection electrode for deflecting electron beams having passed through the focusing electrode; and display means for emitting light be receiving electron beams having passed through the deflection electrode thereon.

In the above-mentioned image display apparatus, diameter of beam spot is minimized even in the extended direction of the line cathodes.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 3(*b*) is a cross-sectional illustration taken on X-Z plane in FIG. 1.

DESCRIPTION OF THE PREFERRED EMBODIMENT

Hereafter, preferred embodiments of the present invention are described with reference to the accompanying drawings.

Figure 1:
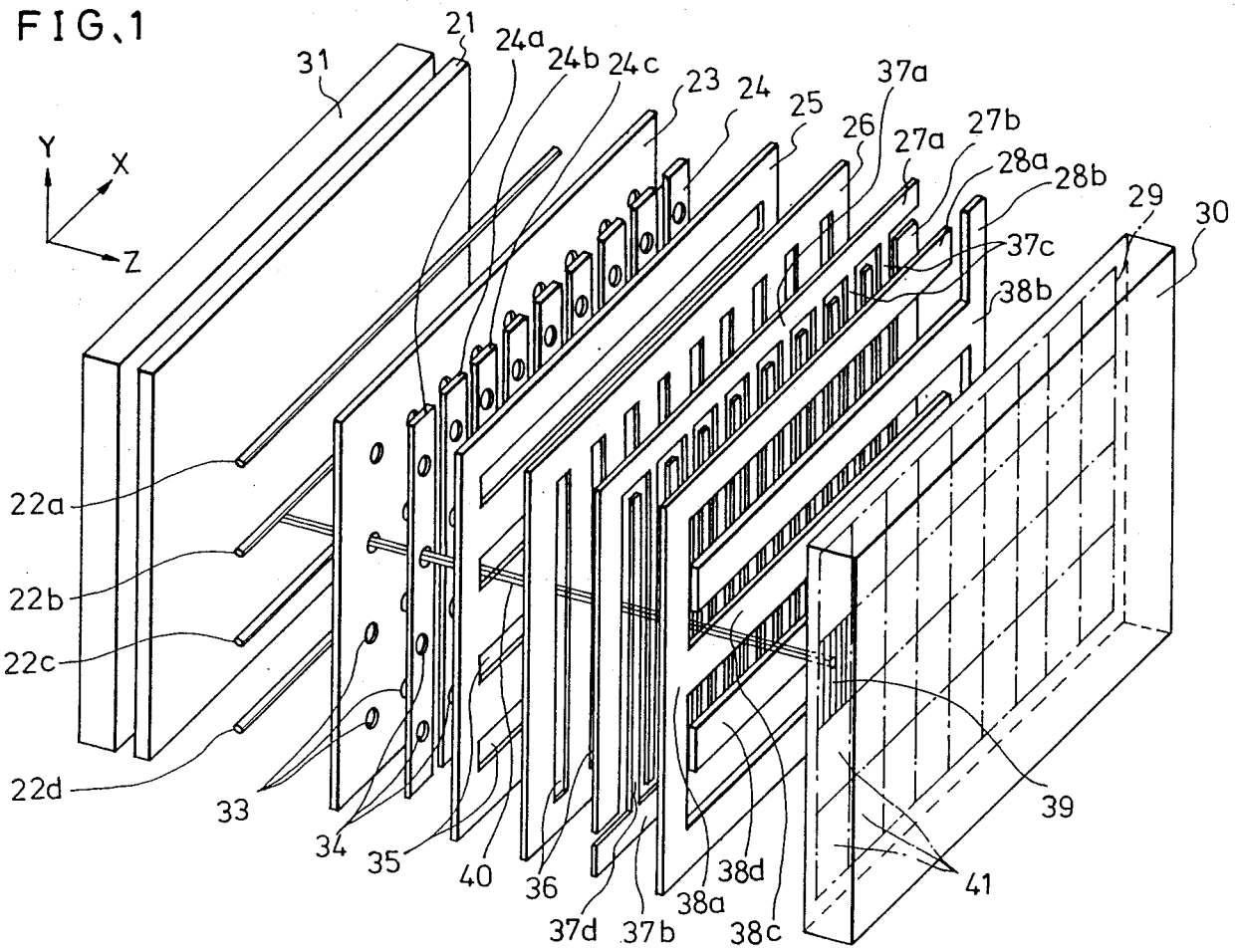
FIG. 1 is an internal perspective view showing an image display apparatuss of a first embodiment of the present invention.

FIG. 1 is an internal perspective view showing an image display apparatus of a first embodiment. A back electrode 21, line cathodes 22*a*, 22*b*, 22*c* and 22*d*, an electron beam extraction electrode 23, a control electrode 24, a first focusing electrode 25, a second focusing electrode 26, a pair of horizontal deflection electrodes 27*a* and 27*b*, a pair of vertical deflection electrodes 28*a* and 28*b* and a screen 29 are held between a rear plate 31 and a front plate 30 in this order in Z-axis of X-Y-Z coordinates shown in the figure and enclosed by both plates 30 and 31 together with upper and bottom plates (not shown) and side plates (not shown). An inside space of the enclosure is evacuated.

The line cathodes 22a–22d are parallelly disposed to each other in the vertical direction (Y-axis) and fixed by holding means (not shown), and each of the line cathodes 22a–22d is extended in the horizontal direction (X-axis) so that electron-flow of nearly uniform current-density-distribution is produced in the horizontal direction. Although only four pieces of line cathodes 22a–22d are shown in the figure, there are actually many line cathodes (e.g. 24 pieces). The line cathodes 22a–22d are made of a tungsten wire and coated with an oxide. The back electrode 21 is made of flat plate-shaped conductor and disposed in parallel with the line cathodes 22a–22d.

The electron beam extraction electrode 23 made of conductive sheet is disposed to oppose against the back electrode 21 across the line cathodes 22a–22d. Plural holes 33 are formed in the electron beam extraction electrode 23 and aligned in the horizontal direction at regular intervals to correspond to each line cathode 22a, 22b, 22c or 22d, thereby making a matrix arrangement as a whole. Although these holes 33 are circular-shaped in the present embodiment, other shapes of aperture such as ellipse-shaped or rectangular-shaped aperture can be also used.

The control electrode 24 comprises plural oblong strips 24a, 24b, 24c . . . which are elongated in the vertical (Y-axis) direction and aligned in the horizontal (X-axis) direction at predetermined intervals, thereby forming a stripe-shaped configuration on a X-Y plane. Plural holes 34 are formed in each of the strips 24a, 24b, 24c . . . at the positions which correspond to the holes 33 of the electron beam extraction electrode 23 in the Z-axis direction, thereby forming the same matrix arrangement on X-Y coordinates as that of the electron beam extraction electrode 23. As for the shape of the holes 34, ellipse or rectangular etc. may be also adopted.

The first focusing electrode 25 is made of conductive sheet and has plural apertures 35 therein. Each of the apertures 35 is elongated in the horizontal (X-axis) direction to correspond to the line cathodes 22a–22d in the Z-axis direction through the holes 33 and 34.

The second focusing electrode 26 is also made of conductive sheet and has plural apertures 36 therein. Each of the apertures 36 is elongated in the vertical (Y-axis) direction to correspond to the strips 24a, 24b, 25c . . . in the Z-axis direction.

The horizontal deflection electrode 27a is made of conductive sheet which is formed into comb-shape comprising comb-teeth parts 37c and a step part 37a connecting all the comb-teeth parts 37c. Also, the horizontal deflection electrode 27b is made of conductive sheet which is formed into comb-shape comprising comb-teeth parts 37d and a stem part 37b connecting all the comb-teeth parts 37d. Both horizontal deflection electrodes 27a and 27b are insulatedly disposed to each other on a common X-Y plane in a manner that each of the comb-teeth parts 37c and each of the comb-teeth parts 37d are alternatively aligned in parallel with each other (hereinafter is referred as "interdigitated") in the vertical direction. Since potentials applied to both horizontal deflection electrode 27a and 27b are different from each other, a potential difference is given between adjacent two comb-teeth parts 37c and 37d, thereby horizontally deflecting the electron beams 40.

The vertical deflection electrode 28a is made of conductive sheet which is formed into a comb-shape wherein comb-teeth parts 38c and a stem part 38c connecting all the comb-teeth parts 38c are provided. Also, the vertical deflection electrode 28b is made of conductive sheet which is formed into a comb-shape wherein comb-teeth parts 38d and a stem part 38b connecting all the comb-teeth parts 38d are provided. Both vertical deflection electrodes 28a and 28b are insulatedly disposed to each other on a common X-Y plane in a manner that each of the comb-teeth parts 38c and each of the comb-teeth parts 38d are interdigitated with each other in the horizontal direction. Since potentials applied to both vertical deflection electrodes 28a and 28b are different from each other, a potential difference is given between adjacent two comb-teeth parts 38c and 38d, thereby vertically deflecting the electron beams 40.

A fluorescent material layer 39 which emits light by irradiation of the electron beams 40 is coated over an inner surface of the faceplate 30, and thereon a metal-back layer (not shown) is attached, thereby constituting the screen 29.

In the above-mentioned image display apparatus, its operation is described hereafter. Voltage $V_1$ is applied to the back electrode 21 and voltage $V_2$ higher than $V_1$ is applied to the electron beam extraction electrode 23. The line cathodes 22a–22d are heated by heater-current in order to easily emit electrons and impressed with voltage $V_0$ ($V_1<V_0<V_2$). At that time, an electric field on the line cathodes 22a–22d becomes positive to the environment, and thereby the electron beams are emitted and accelerated toward the electron beam extraction electrode 23. When the voltage $V_0$ (larger than the voltage $V_2$ ($V_0>V_2$) is applied to the line cathodes 22a–22d, an electric field on the line cathodes 22a–22d becomes negative to the environment, thereby preventing emission of the electron beams. Then, by controlling voltages applied to the respective line cathodes 22a–22d, it becomes possible to control the emission of the electron beams in an order of the line cathodes 22a, 22b, 22c and 22d. Each of the line cathodes 22a–22d emits the electron beams during a predetermined time period from the upper one (22a) to the bottom one (22d) repeatedly. And thereby, each of the line cathodes 22a–22d forms a sheet-shaped electron beams plane (X-Z plane) having a uniform current-density-distribution in the horizontal direction.

Next, the above-mentioned sheet-shaped electron beams are divided into plural separate electron beams 40 in the horizontal direction by passing through the holes 33 of the electron beam extraction electrode 23. Thereafter, plural electron beams 40 arrive at the holes 34 of the control electrode 24. Upon this arrival, by setting voltage $V_3$ on the control electrode 24 to have a relation of $V_3>V_0$, the electron beams 40 are allowed to pass through the holes 34, whereas by setting the voltage $V_3$ to be a relation of $V_3<V_0$, the electron beams 40 lose kinetic energy thereof and cannot pass therethrough. By continuously controlling the voltage $V_3$ in response to video signals, the amount of each electron beam 40 which passes through the holes 34 is controlled.

After passing through the control electrode 24, the electron beams 40 arrive at the first focusing electrode 25. At that time, the electron beams 40 are focused in the direction of the Y-axis by electrostatic-lens-effect presented by the aperture 35. Next, the electron beams 40 arrive at the second focusing electrode 26 and are accelerated toward the direction of the Z-axis by a potential applied to the second focusing electrode 26. Further, the electron beams 40 are shaped by passing through the second focusing electrode 26. After that, the electron beams 40 arrive at the horizontal deflection electrodes 27a and 27b and focused in the direction of the X-axis by electrostatic-lens-effect of the horizontal deflection electrodes 27a and 27b. By making a potential difference (namely deflection voltage) between adjacent two comb-teeth parts 37c and 37d, the electron beams 40 are electrostatically deflected in the direction of the X-axis in response to the potential difference. Next, the electron beams 40 arrive at the vertical deflection electrodes 28a and 28b and are focused in the direction of the Y-axis by electrostatic-lens-effect of the vertical deflection electrodes 28a and 28b. By making a potential difference (deflection voltage) between adjacent two comb-teeth parts 38c and 38d, the electron beams 40 are electrostatically deflected in the direction of the Y-axis in response to the potential difference.

Finally, the electron beams 40 are accelerated to have a high energy by a high voltage (e.g. 10 kV) applied to the metal-back layer of the screen 29. These electron beams 40 having a high energy collide with the metal-back layer, thereby emitting light from the fluorescent material layer 39.

The screen 29 is horizontally and vertically divided into the matrix arrangement of plural sectional screen 41. Each of the sectional screens 41 is scanned by deflecting one electron beam which is separated from the other electron beams. Thereby, the whole image is displayed on the screen 29. R, G and B video signals corresponding to respective picture elements are continuously controlled by the voltage applied to the control electrode 24, and thereby the television image is reproduced.

Figure 2:
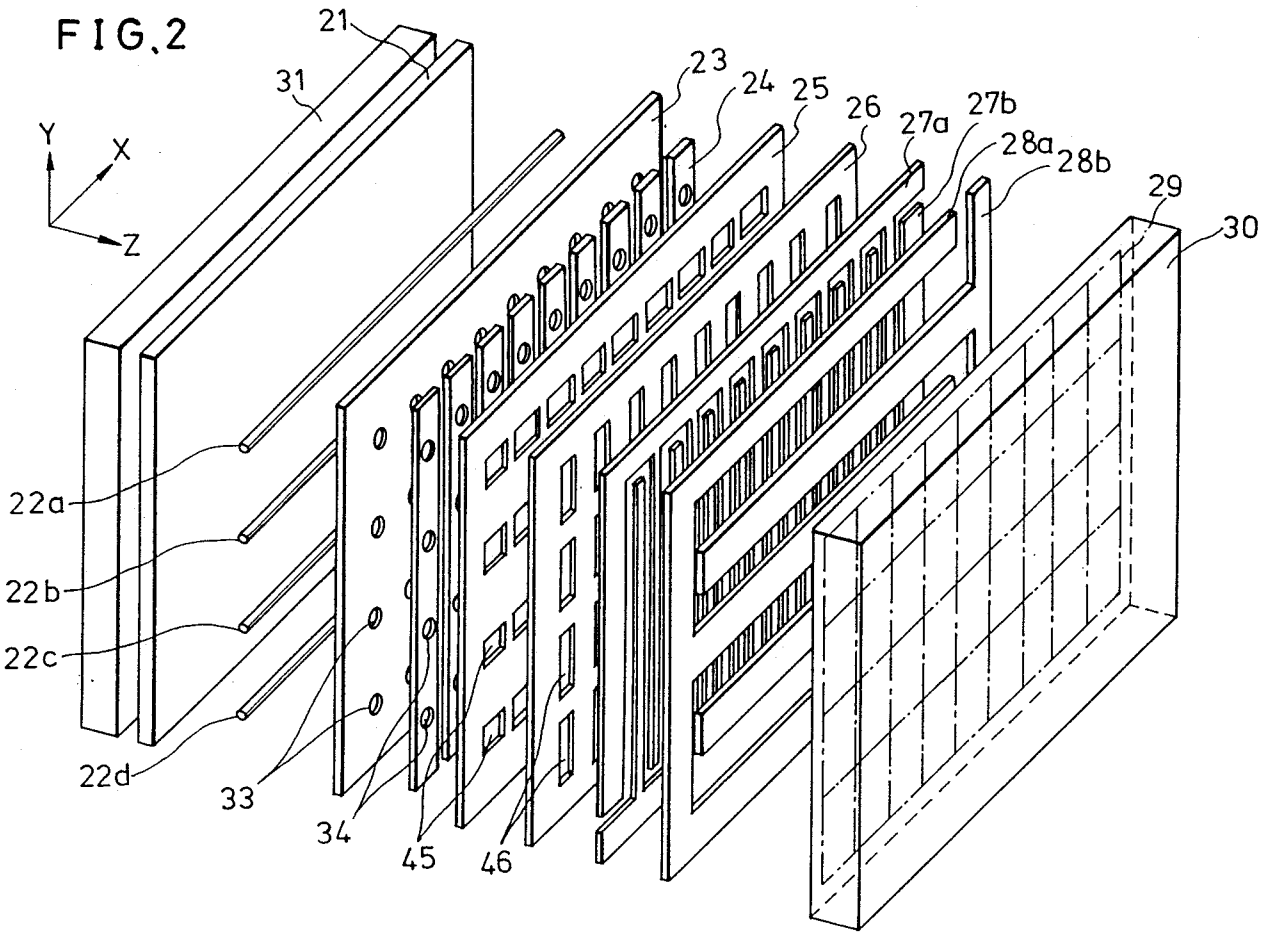
FIG. 2 is an internal perspective view showing an image display apparatus of a second embodiment of the present invention.

FIG. 2 is an internal perspective view showing the image display apparatus of a second embodiment. Corresponding parts to the first embodiment are shown by the same numerals and marks, and the description thereon made in the first embodiment similarly applies. Differences between the first embodiment and the second embodiment are as follows. In the first focusing electrode 25 and the second focusing electrode 26, rectangular holes 45 and 46 are formed into matrix arrangements, respectively. Positions of the holes 45 and 46 in a X-Y plane correspond to the holes 33 of the electron beam extraction electrode 23 and the holes 34 of the control electode 24. Hereupon, the hole 45 is elongated in the horizontal (X-axis) direction and the hole 46 is elongated in the vertical (Y-axis) direction. Electrostatic-lens-effects on respective center positions of the holes 45 and 46 are substantially equal to those of the apertures 35 and 36 in the FIG. 1, respectively.

In the above-mentioned both embodiments, the parts which constitute the image display apparatus are thin plate-shaped or sheet-shaped. The depth (in Z-axis) of the image display apparatus is thereby shortened as a whole, and a flat screen is offered.

Figure 3A:
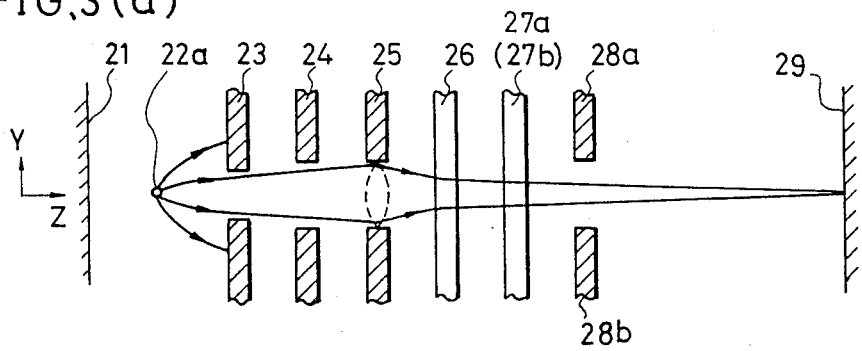
FIG. 3(*a*) is a cross-sectional illustration taken on Y-Z plane in FIG. 1.
Figure 3B:
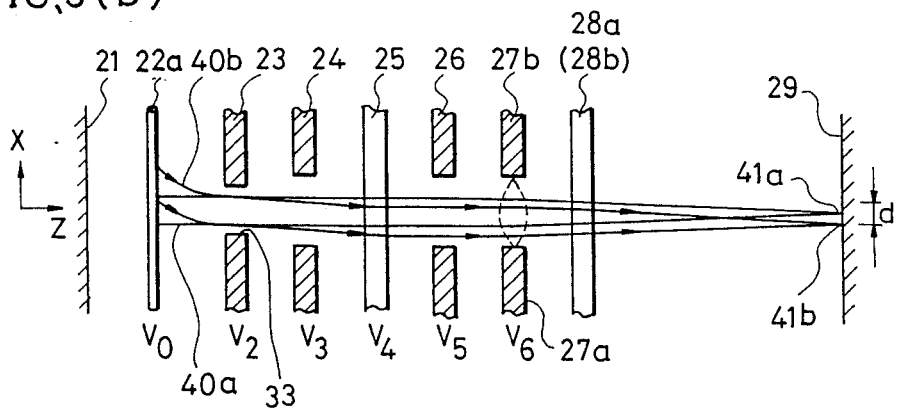

FIG. 3(*a*) is a cross-sectional illustration taken on a plane Y-Z in FIG. 1, and FIG. 3(*b*) is a cross-sectional illustration taken on a plane X-Y in FIG. 1. Corresponding parts to FIG. 1 are shown by the same numerals and marks, and the description thereon made in FIG. 1 similarly applies.

Thermions having initial velocity responding to heat energies thereof are nondirectionally emitted from around the line cathode 22a. Therefore, there exists not only a flow of electron beam 40a but also another flow of electron beam 40b. That is, some thermions emitted from the line cathode 22a obliquely enter the hole 33 of the electron beam extraction electrode 23 as shown by the electron beam 40b. When the voltage $V_2$ of the electron beam extraction electrode 23, the voltage $V_3$ of the control electrode 24 and the voltage $V_4$ of the first focusing electrode 25 are set to be nearly equal to each other and the voltage $V_5$ of the second focusing electrode 26 is set to be considerably higher than the voltages $V_2$, $V_3$ and $V_4$, an electric-field-gap is formed in the aperture 35 (FIG. 1) of the first focusing electrode 25. However, since the aperture 35 is narrow and long in the direction of X-axis, an electrostatic-focusing-effect is effective only in the direction of the Y-axis and the electric field is little changed in the direction of the X-axis. As a result, in the X-Z plane, the electron beams 40a and 40b are accelerated toward the direction of the Z-axis by the voltage of the second focusing electrode 26 without focusing, thereby desirably fixing electron flow. On the other hand, the horizontal deflection electrodes 27a and 27b provide electrostatic-focusing-effect only in the direction of the X-axis by setting the voltage $V_6$ of the horizontal deflection electrodes 27a and 27b to be lower than the voltage $V_5$, thereby obtaining a beam spot of horizontally (i.e. on X-Z plane) minimum diameter d on the screen 29. A desirable small beam spot is thus realized. When the voltage difference $\Delta V$ is given onto the horizontal deflection electrodes 27a and 27b; namely the voltage of $V_6+\Delta V/2$ is applied to one of the horizontal deflection electrodes 27a and 27b and the voltage of $V_6-\Delta V/2$ is applied to the other one, the electron beam 40a or 40b is horizontally deflected. At that time, the electrostatic-focusing-effect is nearly equal to that of the case having no voltage difference, irrespective of the voltage difference $\Delta V$. As for vertical deflection, the description made above is similarly applied.

Figure 4:
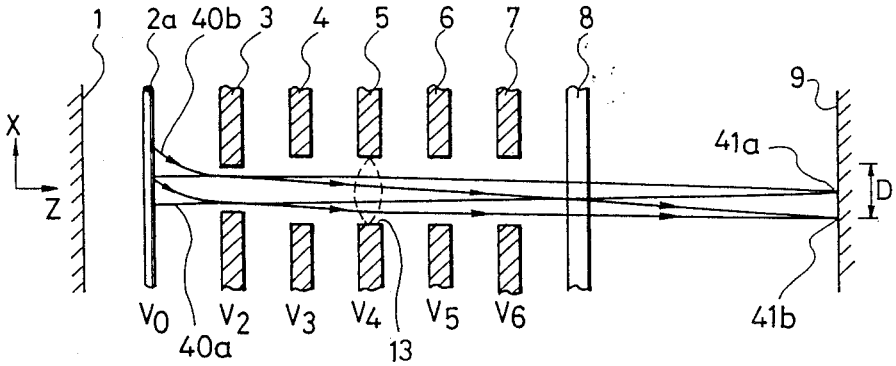
FIG.4 (Prior Art)
FIG. 4 is the cross-sectional illustration taken on X-Z plane in FIG. 6.
Figure 6:
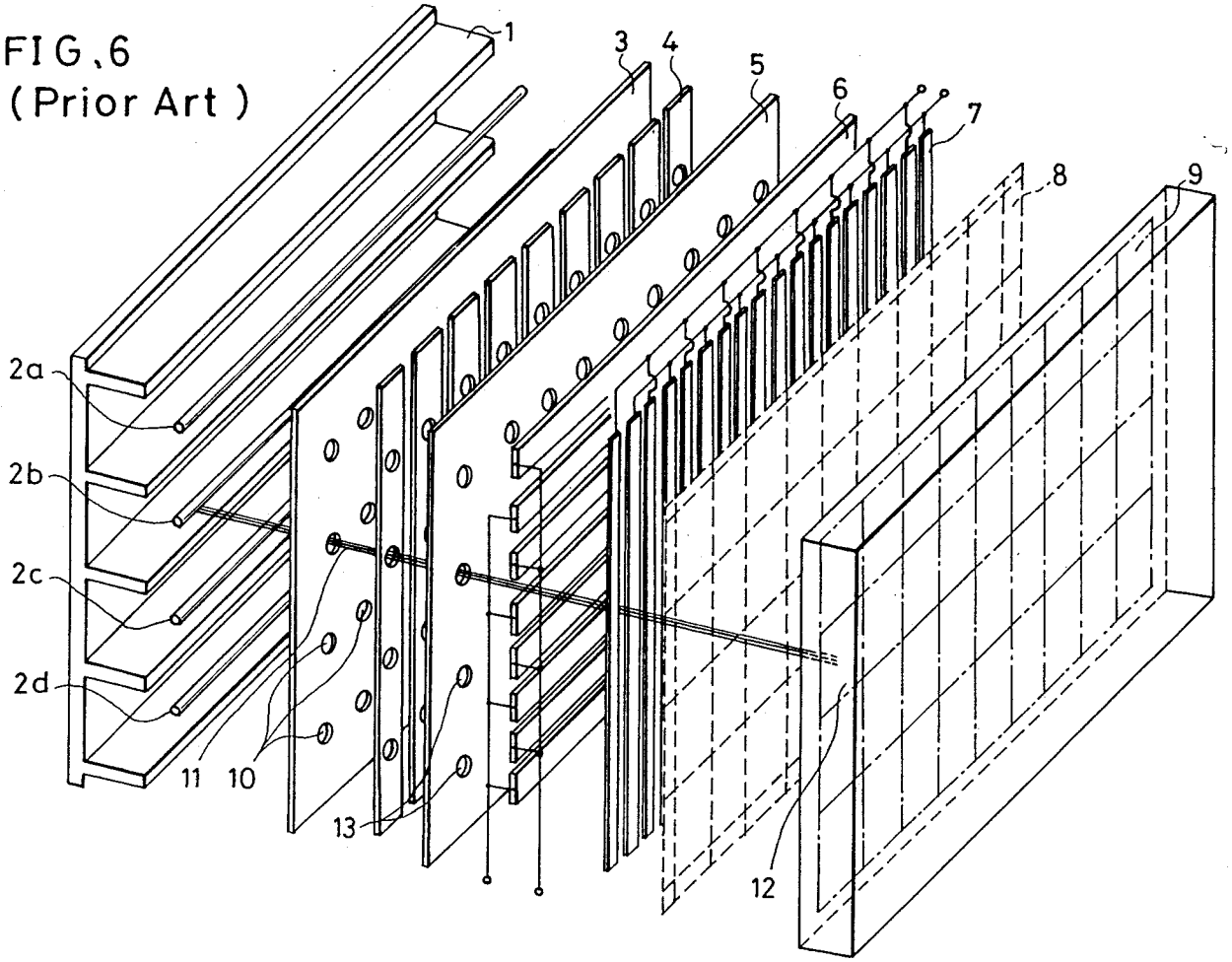
FIG. 6 (Prior Art)
FIG. 6 is the internal perspective view showing the conventional image display apparatus.

FIG. 4 is a cross-sectional illustration taken on an X-Z plane of the conventional image display apparatus shown in FIG. 6. A cross-sectional illustration taken on a Y-Z plane is similar to FIG. 3(*a*). In FIG. 4, since an electrostatic lens is formed in the hole 13 of the focusing electrode 5 on the X-Z plane owing to the fact that apertures of the first focusing electrode 5 are circular holes 13, oblique electron beam 40b is focused before fixing of a travelling direction toward the direction of Z-axis. Consequently, the position of a focus 41a of the eletron beam 40a is away from that of a focus 41b of the electron beam 40b on the screen 9. Thereby, a diameter D of the beam spot on the horizontal (X-Z) plane is enlarged, and the quality of the image is deteriorated.

Hereupon, in comparison with the conventional image display apparatus, disposition of the horizontal deflection electrodes 27a and 27b and the vertical deflection electrodes 28a and 28b of the present invention are reversed. That is, the vertical deflection electrodes 28a and 28b in the present invention are disposed in the final step to pass the electron beam. In the conventional disposition wherein the vertical deflection electrode 6 is disposed before the horizontal deflection electrode 7 as shown in FIG. 4, vertical focusing of the electron beams becomes dull because the subsequent horizontal deflection electrode 7 undesirably has a slight influence on the electron beams in the vertical direction, thereby resulting in a decline of sensitivity of deflection. It is possible to decrease such an influence by limiting the deflection angle. However, since a number of line cathodes is restricted due to an economical reason etc., the above-mentioned problem has been unavoidable. On the other hand, the above-mentioned disposition of the present invention is advantageous to precisely deflect the electron beam in the vertical direction, and thereby excellent sensitivity of deflection is obtained.

Next, working and assembling methods of electrodes are described. In order to obtain an image which has excellent uniformity without noticeable border lines between sectional screens 41 and 41, high-precision working and assembling are required for respective electrodes. Since the electrodes 23, 24, 25, 26, 27*a*, 27*b*, 28*a* and 28*b* are all made of thin conductive sheet, etching can be applied to make holes 33, 34, apertures 35 (45), 36 (46) and comb-shaped configuration of the deflection electrodes 27*a*, 27*b*, 28*a*, 28*b*. Thereby, high-precision working such as of the order of micrometer can be realized.

For example, a working method of the control electrode 24 comprising plural conductive sheets is described. Firstly, the control electrode 24 is made of one sheet wherein plural strips and crosspieces connecting the strips are provided by etching. Secondly, respective electrodes 23–28*a*, 28*b* are fixedly laminated with insulation spacerss put therebetween. Finally, the crosspieces are removed by irradiating laser beam, thereby making a stripe-shaped control electrode 24. Thus, respective electrodes are precisely worked and assembled with low manufacturing cost.

Figure 5:
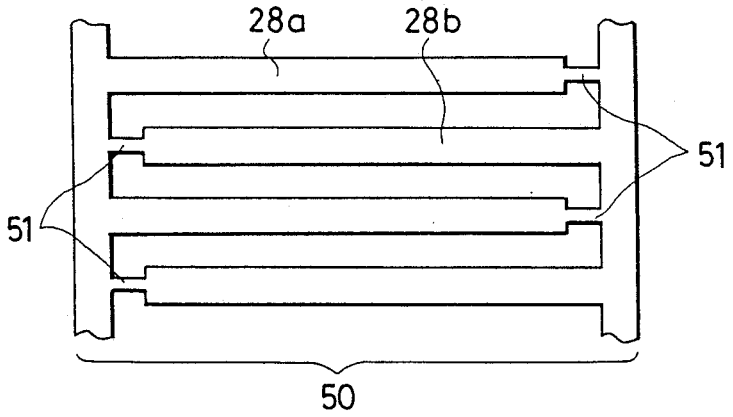
FIG. 5 is a plane view showing a conductive sheet 50 before making a pair of vertical deflection electrodes 28*a* and 28*b*.

FIG. 5 is a plane view showing a conductive sheet 50 before making a pair of vertical deflection electrodes 28*a* and 28*b*. Hereafter, an example of actual making method of making the vertical deflection electrodes 28*a* and 28*b* is described. Firstly, a piece of conductive sheet 50 is formed by etching a pattern into the configuration shown in the figure, wherein the vertical deflection electrode 28*a* and the vertical deflection electrode 28*b* are connected with each other via thin crosspieces 51. Secondly, respective electrodes 23–28*a*, 28*b* (FIG. 1) are laminated and fixed. Finally, the crosspieces 51 are removed by irradiating laser beam, thereby making a pair of comb-shaped vertical deflection electrodes 28*a* and 28*b* which are isolated from each other. According to the above-mentioned working and assemblying method, errors in parallelism, spacing and flatness in the direction of Z-axis of the comb-teeth parts 38*c* and 38*d* (FIG. 1) are minimized, thereby enabling high-precision working and assemblying. As for the horizontal deflection electrodes 27*a* and 27*b*, the above-mentioned description is similarly applied.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An image display apparatus comprising:

a plurality of line cathodes which are extended in parallel with each other to emit electrons;

an electron beam extraction electrode for extracting electron beams from said line cathodes;

a control electrode for selectively controlling a passing amount of electron beams having passed through said electron beam extraction electrode;

a first focusing electrode for electrostatically focusing electron beams having passed through said control electrode, said first focusing electode being of a conductive sheet in which a plurality of oblong apertures elongated in an extended direction of said line cathodes are formed;

a second focusing electrode which is disposed adjacent to said first focusing electrode and electrostatically focuses electron beams having passed through said first focusing electrode, said second focusing electrode being of a conductive sheet in which a plurality of oblong apertures elongated in a perpendicular direction to the extended direction of said line cathodes are formed;

a deflection electrode for deflecting electron beams having passed through said second focusing electrode; and display means for emitting light by receiving electron beams having passed through said deflection electrode thereon.

2. An image display apparatus comprising:

a plurality of line cathodes which are extended in parallel with each other to emit electrons;

an electron beam extraction electrode for extracting electron beams from said line cathodes;

a control electrode for selectively controlling passing amount of electron beams having passed through said electron beam extraction electrode;

a focusing electrode for electrostatically focusing electron beams having passed through said control electrode;

a horizontal deflection electrode for electrostatically deflecting electron beams having passed through said focusing electrode in an extended direction of said line cathodes;

a vertical deflection electrode for electrostatically deflecting electron beams having passed through said horizontal deflection electrode in an perpendicular direction to the extended direction of said line cathodes; and display means for emitting light by receiving electron beams having passed through said vertical deflection electrode thereon;

the above-mentioned components being disposed in this sequential order.

3. An image display apparatus in accordance with claim 2, wherein said focusing electrode is of a conductive sheet wherein a plurality of oblong apertures elongated in an extended direction of said line cathodes are formed.

4. An image display apparatus in accordance with claim 2, wherein said focusing electrode comprises:

a first focusing electrode which is made of a conductive sheet wherein a plurality of oblong apertures elongated in an extended direction of said lines cathodes are formed, and a second focusing electrode which is made of a conductive sheet wherein a plurality of oblong apertures elongated in a perpendicular direction to the extended direction of said line cathodes are formed.

5. An image display apparatus comprising: a plurality of line cathodes which are extended in parallel with each other to emit electrons;

an electron beam extraction electrode for extracting electron beams from said line cathodes;

a control electrode for selectively controlling a passing amount of electron beams having passed through said electron beam extraction electrode;

a focusing electrode for electrostatically focusing electron beams having passed through said control electrode;

a horizontal deflection electrode for electrostatically deflecting electron beams having passed through said focusing electrode in an extended direction of said line cathodes;

a vertical deflection electrode for electrostatically deflecting electron beams having passed through said horizontal deflection electrode in a perpendicular direction to the extended direction of said line cathodes; and display means for emitting light by receiving electron beams having passed through vertical deflection electrode thereon;

the above-mentioned components being disposed in this sequential order, wherein said horizontal deflection electrode comprises a pair of comb-shaped conductive sheets which are insulatedly interdigitated with each other in a vertical direction on the same plane.

6. An image display apparatus in accordance with claim 2, wherein said vertical deflection electrode comprises a pair of comb-shaped conductive sheets which are insulatedly interdigitated with each other in a horizontal direction on the same plane.

7. An image display apparatus comprising:

a plurality of line cathodes which are extended in parallel with each other to emit electrons;

an electron beam extraction electrode for extracting electron beams for said line cathodes;

a control electrode for selectively controlling a passing amount of electron beams having passed through said electron beam extraction electrode;

a first focusing electrode for electrostatically focusing electron beams having passed through said control electrode, said first focusing electrode being of a conductive sheet in which a plurality of oblong apertures elongated in an extended direction of said line cathodes are formed;

a second focusing electrode which is disposed adjacent to said first focusing electrode and electrostatically focuses electron beams having passed through said first focusing electrode, said second focusing electrode being of a conductive sheet in which a plurality of oblong apertures elongated in a perpendicular direction to the extended direction of said line cathodes are formed;

a horizontal deflection electrode for electrostatically deflecting electron means having passed through said focusing electrode in an extended direction of said line cathodes;

a vertical deflection electrode for electrostatically deflecting electron beams having passed through said horizontal deflection electrode in an perpendicular direction to the extended direction of said line cathodes; and display means for emitting light by receiving electron beams having passed through said vertical deflection electrode thereon;

the above-mentioned components being disposed in this sequential order.

8. An image display apparatus comprising:

a plurality of line cathodes which are extended in parallel with each other to emit electrons;

an electron beam extraction electrode for extracting electron beams from said line cathodes;

a control electrode for selectively controlling passing amount of electron beams having passed through said electron beam extraction electrode;

a focusing electrode for electrostatically focusing electron beams having passed through said control electrode, said focusing electrode being of a conductive sheet wherein a plurality of oblong apertures elongated in an extended direction of said line cathodes are formed;

a horizontal deflection electrode for electrostatically deflecting electron beams having passed through said focusing electrode in an extended direction of said line cathodes;

a vertical deflection electrode for electrostatically deflecting electron beams having passed through said horizontal deflection electrode in an perpendicular direction to the extended direction of said line cathodes; and display means for emitting light by receiving electron beams having passed through said vertical deflection electron thereon;

the above-mentioned components being disposed in this sequential order, wherein said horizontal deflection electrode comprises a pair of comb-shaped conductive sheets which are insulatedly interdigitated with each other in a vertical direction on the same plane.

9. An image display apparatus in accordance with claim 7, wherein said vertical deflection electrode comprises a pair of comb-shaped conductive sheets which are insulatedly interdigitated with each other in a horizontal direction on the same plane.

10. An image display apparatus in accordance with claim 7, wherein said horizontal deflection electrode comprises a pair of comb-shaped conductive sheets which are insulatedly interdigitated with each other in a vertical direction on the same plane, and said vertical deflection electrode comprises a pair of comb-shaped conductive sheets which are insulatedly interdigitated with each other in a horizontal direction on the same plane.

* * * * *